US006398386B1

(12) United States Patent
Huang

(10) Patent No.: US 6,398,386 B1
(45) Date of Patent: Jun. 4, 2002

(54) PROTECTING AND DECORATIVE STRUCTURE FOR CRAB-EYE STYLE LAMPS WITHOUT LAMP HOLDERS

(75) Inventor: Peter K. H. Huang, Taipei (TW)

(73) Assignee: Shining Blick Enterprises Co., Ltd. (TW)

( * ) Notice: Subject to any disclaimer, the term of this patent is extended or adjusted under 35 U.S.C. 154(b) by 0 days.

(21) Appl. No.: 09/689,792

(22) Filed: Oct. 13, 2000

(51) Int. Cl.[7] ..... H01R 33/00

(52) U.S. Cl. ..... 362/226; 362/255; 362/807; 362/249

(58) Field of Search ..... 362/226, 249, 362/255, 807

(56) References Cited

U.S. PATENT DOCUMENTS 5,165,789 A * 11/1992 Womack ..... 362/391

5,311,417 A * 5/1994 Heh ..... 362/397

* cited by examiner

*Primary Examiner*—Sandra O'Shea
*Assistant Examiner*—Ronald E. DelGizzi
(74) *Attorney, Agent, or Firm*—Troxell Law Offices PLLC

(57) ABSTRACT

A decorative structure including a crab-eye style lamp without a lamp holder, has a lamp bulb on a bottom surface connected with a pair of conductors separated and positioned by means of an insulation block. A thin sleeve is combined by heat shrinking with a connecting area between the exposed conductor sections of the lamp bulb and the conductors sections. A light penetrable decoration member of any of various configurations has a positioning hole in communication with the outside and extending into the decoration member for a predetermined depth. The crab-eye style lamp completely enters the positioning hole of the decoration member to provide a safer structure and a more attractive decorative effect when the lamp bulb is illuminated and shining.

8 Claims, 7 Drawing Sheets

PROTECTING AND DECORATIVE STRUCTURE FOR CRAB-EYE STYLE LAMPS WITHOUT LAMP HOLDERS

BACKGROUND OF THE INVENTION

1. Field of the invention

The present invention is related to a protecting and decorative structure having a crab-eye style lamp, and especially such having a protecting function and decoration effect for a crab-eye style lamp. The crab-eye style lamps described in the present invention are those lamps having their lamp bulbs not inserted into holders; while their two exposed pins are directly connected to conductors for decoration by lightening or flashing. By virtue that the lamp bulbs are smaller, they are provided directly at the ends of the conductors, and are in the shape like crab eyes, thereby, they are called "crab-eye style lamps" in the art.

2. Description of the Prior Art

The conventional structure of such a crab-eye style lamp is made in a factory, such as is shown in FIG. 1, to have an external heat shrinking sleeve 12 fixed on a joint section between a bead 10 such as a lamp bulb and a conductor 11 when assembling. The internal processing procedure in assembly further includes welding of the polar pin of the bead to the end of the conductor 11. Then the external heat shrinking sleeve 12 is fixed by heat shrinking. The heat shrinking sleeve 12 is provided between the hard lamp bulb and the soft conductor, thus it is often uneven and wrinkled to make the appearance of the whole lamp very unattractive. Besides, such structure of the single layered heat shrinking sleeve has an inferior leakage-proof function, and a non-ideal condition of safety. It is very hard to obtain approval of those countries with more severe standards.

SUMMARY OF THE INVENTION

The object of the present invention is to provide a protecting and decorative structure for a crab-eye style lamp. A decoration member is combined with a crab-eye style lamp whereby the decoration member can be any of various types having at least a through hole extending from an outside to the interior thereof for a suitable length. The decoration member is made of light penetrable material in order that when the crab-eye style lamp and the heat shrinking sleeve thereof are placed into the through hole, a more attractive and beautiful decorative function can be obtained. Meantime, the crab-eye style lamp is combined in and with the decoration member in a protected state.

The present invention has another object, that is to provide a protecting and decorative structure for a crab-eye style lamp wherein the crab-eye style lamp can reach and be mounted at a suitable position deep in the decoration member, in order to give the function of light emitting and decoration matching with the style of the decoration member.

The present invention will be apparent in its novelty and features after reading the detailed description of the preferred embodiment thereof in reference to the accompanying drawings.

DETAILED DESCRIPTION OF THE PREFERRED EMBODIMENT

Figure 1:
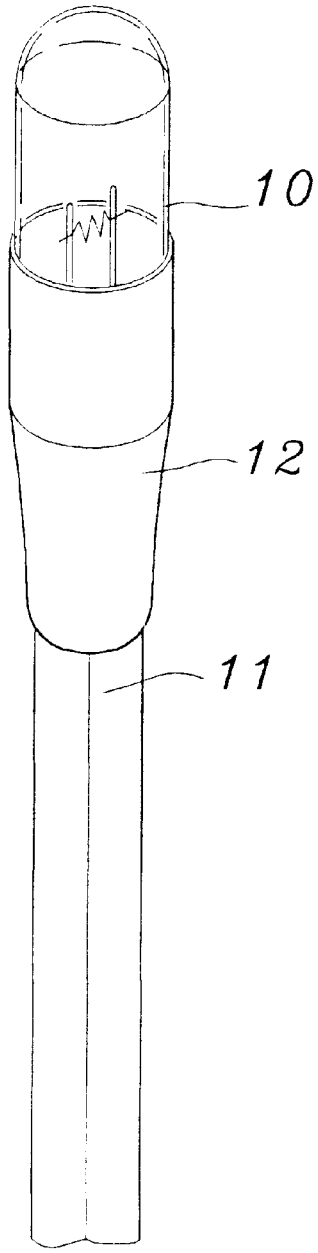
FIG. 1 PRIOR ART
FIG. 1 is a perspective view of a conventional crab-eye style lamp.
Figure 2:
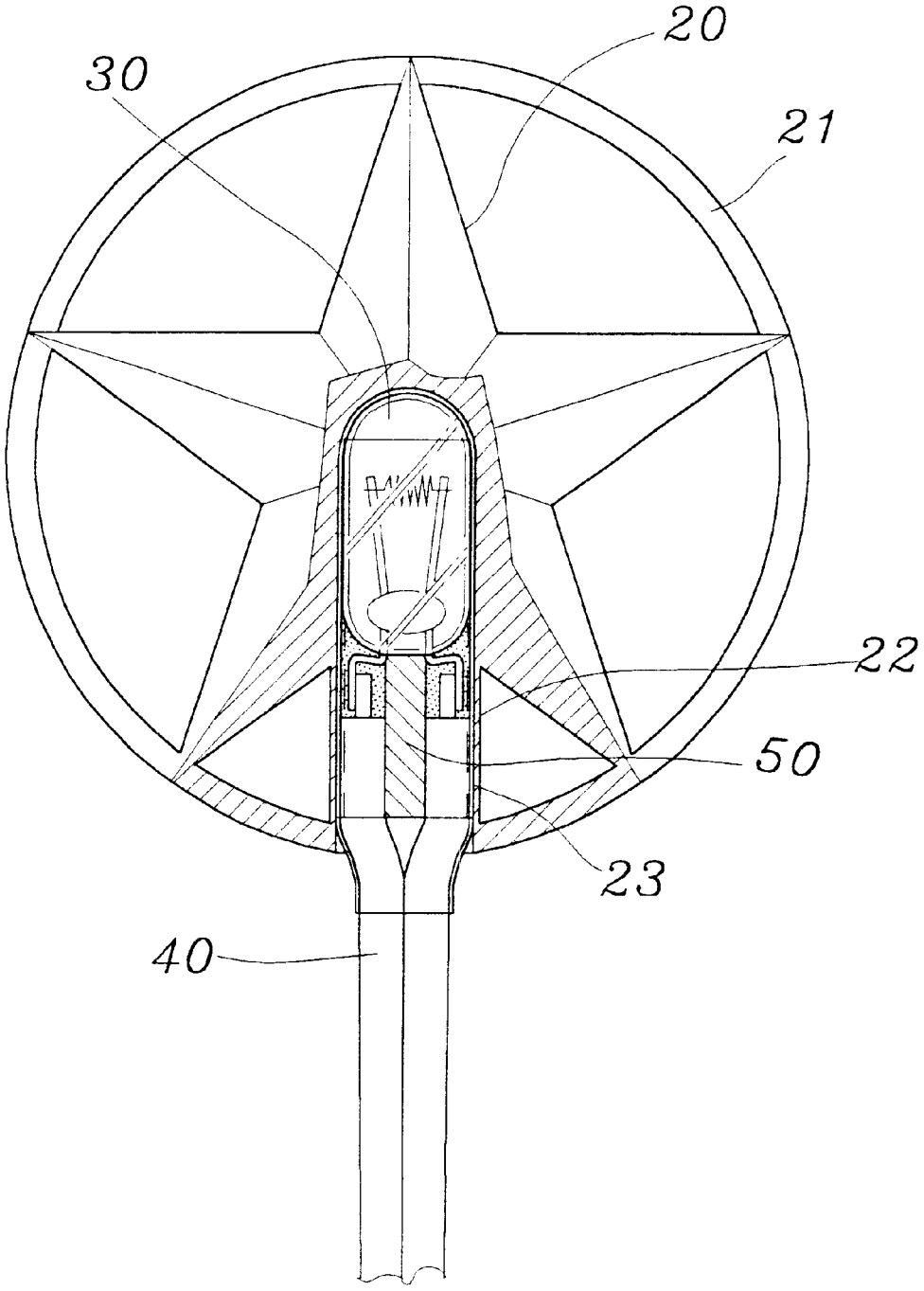
FIG. 2 is a front view, partially broken away, of a preferred embodiment of the present invention, showing a joint section between a decoration member and a crab-eye style lamp.
Figure 3:
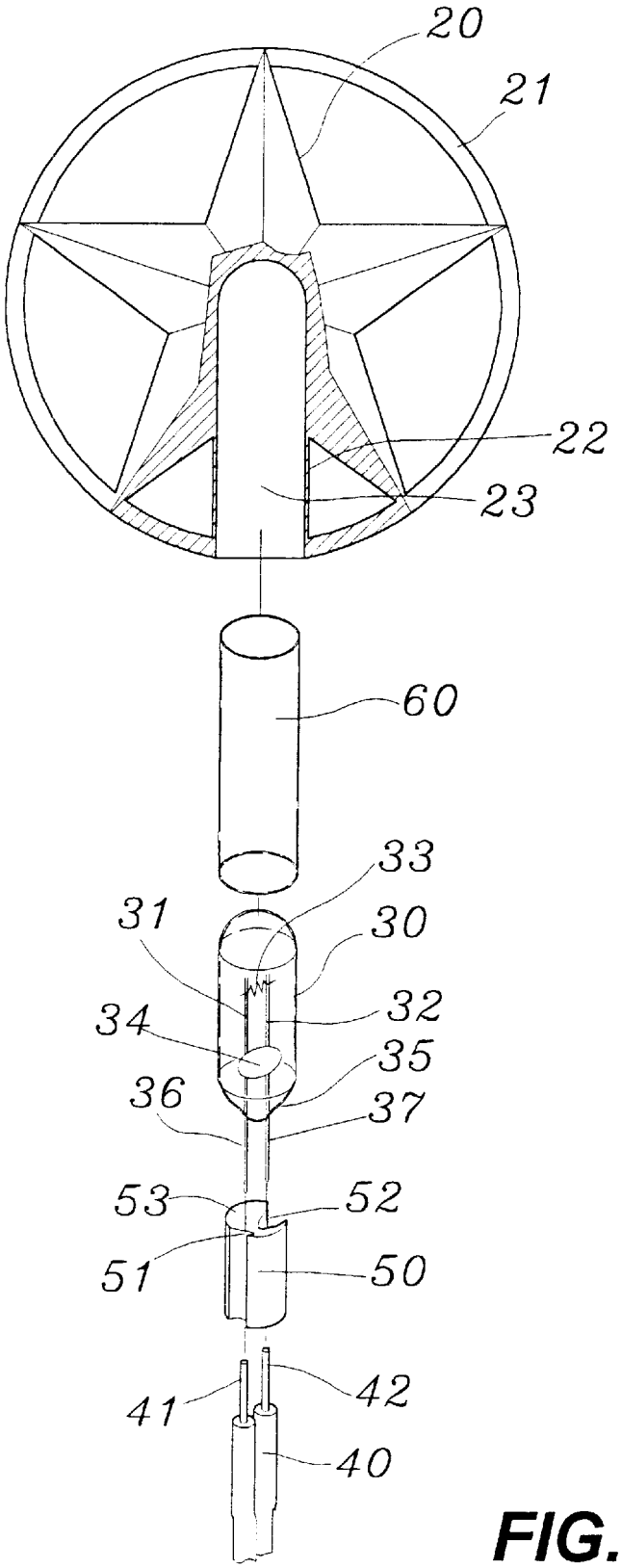
FIG. 3 is an exploded perspective view showing the elements in FIG. 2.

Referring to FIGS. 2, 3, a decoration member 20 in the shape of a five pointed star made of light penetrable material as an example, has an external ring 21, an extension 22 integrally provided between two points, and a positioning hole 23 of suitable diameter as well as length, provided in the extension 22. In the preferred embodiment shown in the drawing, one end (the bottom end as shown) of the positioning hole 23 communicates with the outside of the decoration member 20, while the other end thereof (the upper end as shown in the drawing) extends to approach to the center of the five pointed star.

A crab-eye style lamp of the present invention can have any of various structure. In the preferred embodiment shown in the drawing, a miniature lamp bulb 30 has two separated conductors 31, 32 in the transparent lamp shell thereof, and a tungsten filament 33 connecting the ends of the two conductors 31, 32. The conductors 31, 32 are kept a fixed distance apart by means of an insulation bead 34. The miniature lamp bulb 30 has on its curved bottom surface 35 two exposed conductor sections 36, 37 for connecting with a pair of conductors 40. The insulation of conductors 40 can be removed to leave two naked conductor sections 41, 42 connected with the conductor sections 36, 37.

Figure 4:
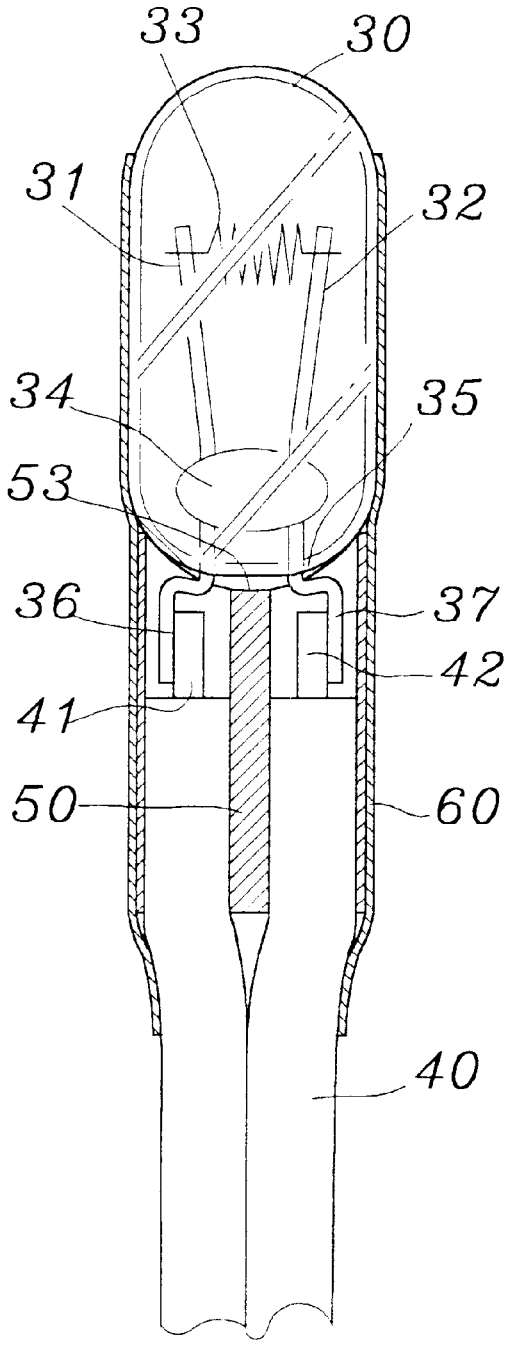
FIG. 4 is a sectional view of the crab-eye style lamp in FIG. 3 showing its structure.

The two exposed conductor sections 36, 37 and the two naked conductor sections 41, 42 are separated and positioned by means of an insulation block 50. In the preferred embodiment as shown in the drawings, the insulation block 50 includes on two lateral sides thereof two axially directed grooves 51, 52 for positioning the connected conductors 40. The top surface 53 of the insulation block 50 is recessed and curved for bearing against the curved bottom surface 35 of the miniature lamp bulb 30. The crab-eye style lamp as shown in FIG. 4 is completed by adding a thin sleeve 60 by a heat shrinking process.

Figure 5:
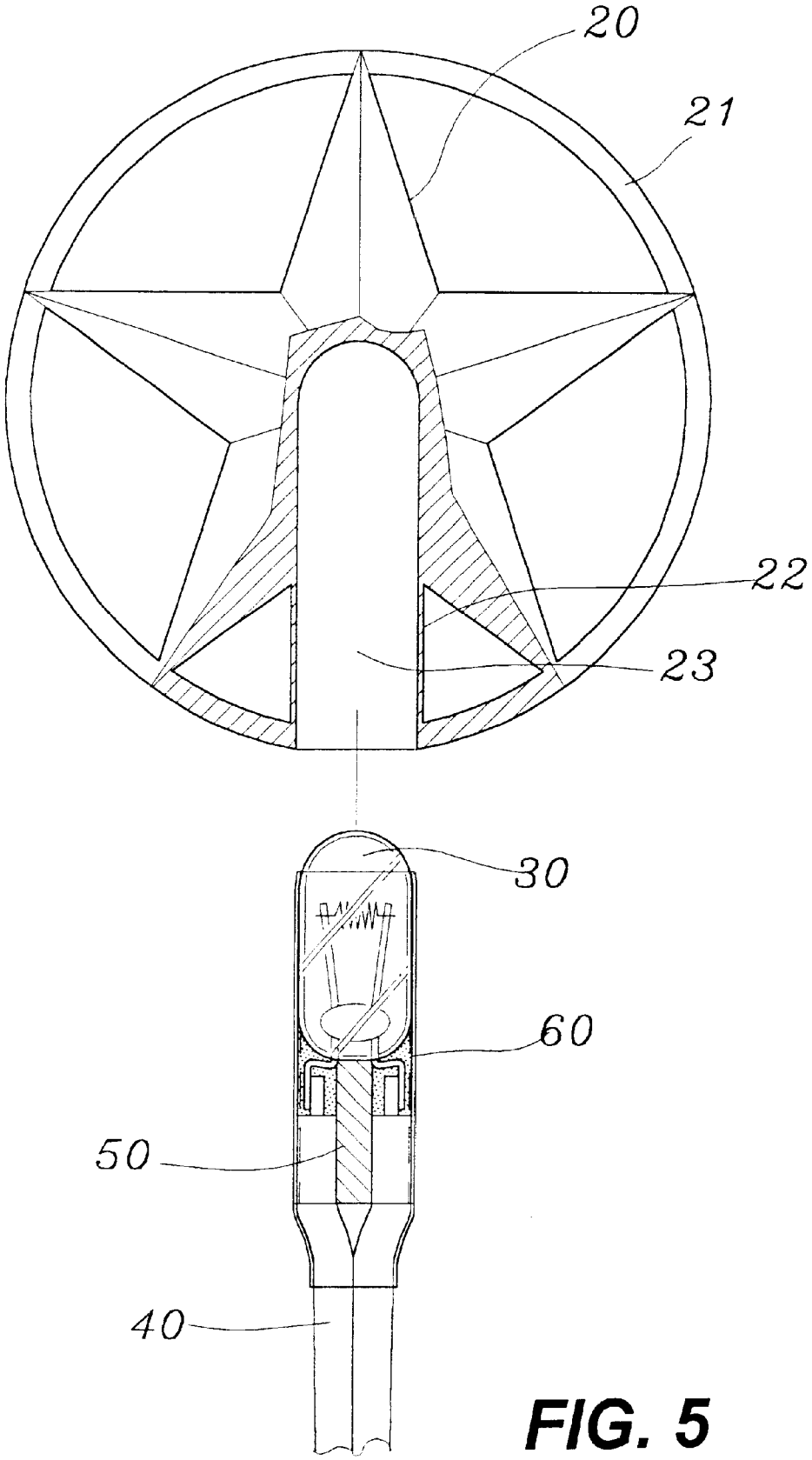
FIG. 5 is an exploded perspective view showing the assembling of the crab-eye style lamp in FIG. 2 with the decoration member.

The crab-eye style lamp is aligned with the positioning hole 23 of the decoration member 20 as shown in FIG. 5. In the preferred embodiment shown in the drawings, the connection area of the miniature lamp bulb 30 with the conductors 40 of the crab-eye style lamp is extended into the positioning hole 23 of the decoration member 20, so that the thin sleeve 60 becomes a lining layer which can tightly combine the whole crab-eye style lamp with the decoration member 20. Otherwise, the crab-eye style lamp and the decoration member 20 can be combined hermetically and integrally with each other by way of glue. This embodiment can place the miniature lamp bulb 30 closely to the center of the five pointed star decoration member 20. When illuminated and flashing, reflecting light beams will irradiate the whole five pointed star and the external ring 21 of the decoration member 20.

Figure 6:
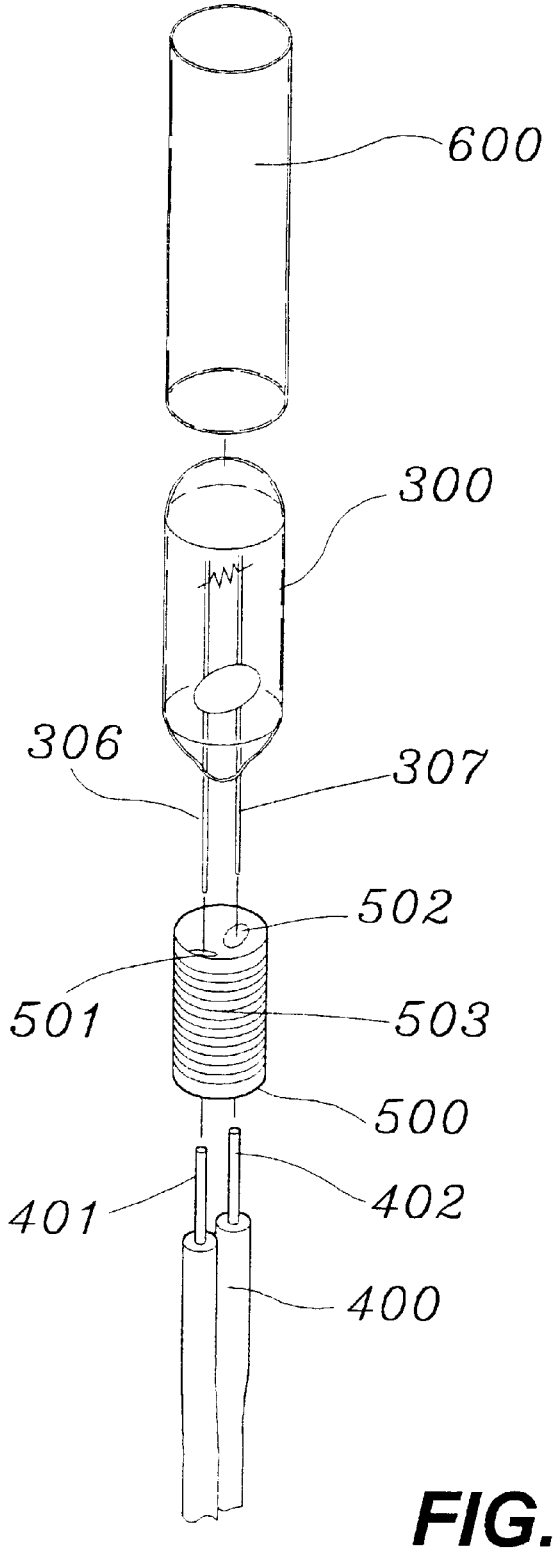
FIG. 6 is an exploded perspective view showing the present invention used on a crab-eye style lamp of another structure.

In another embodiment shown in FIG. 6, exposed conductor sections 306,307 of a miniature lamp bulb 300 of the crab-eye style lamp can similarly be connected to two naked conductor sections 401, 402 of the conductors 40 but can be separated and positioned by means of an insulation block 500 with another structure. Then a thin sleeve 600 is combined therewith by a heat shrinking process. In this embodiment, the insulation block 500 is provided, with two axially directed grooves or two through holes 501, 502 as depicted in the drawing. The external wall 503 can be knurled to increase the strength of combination by heat shrinking.

Figure 7:
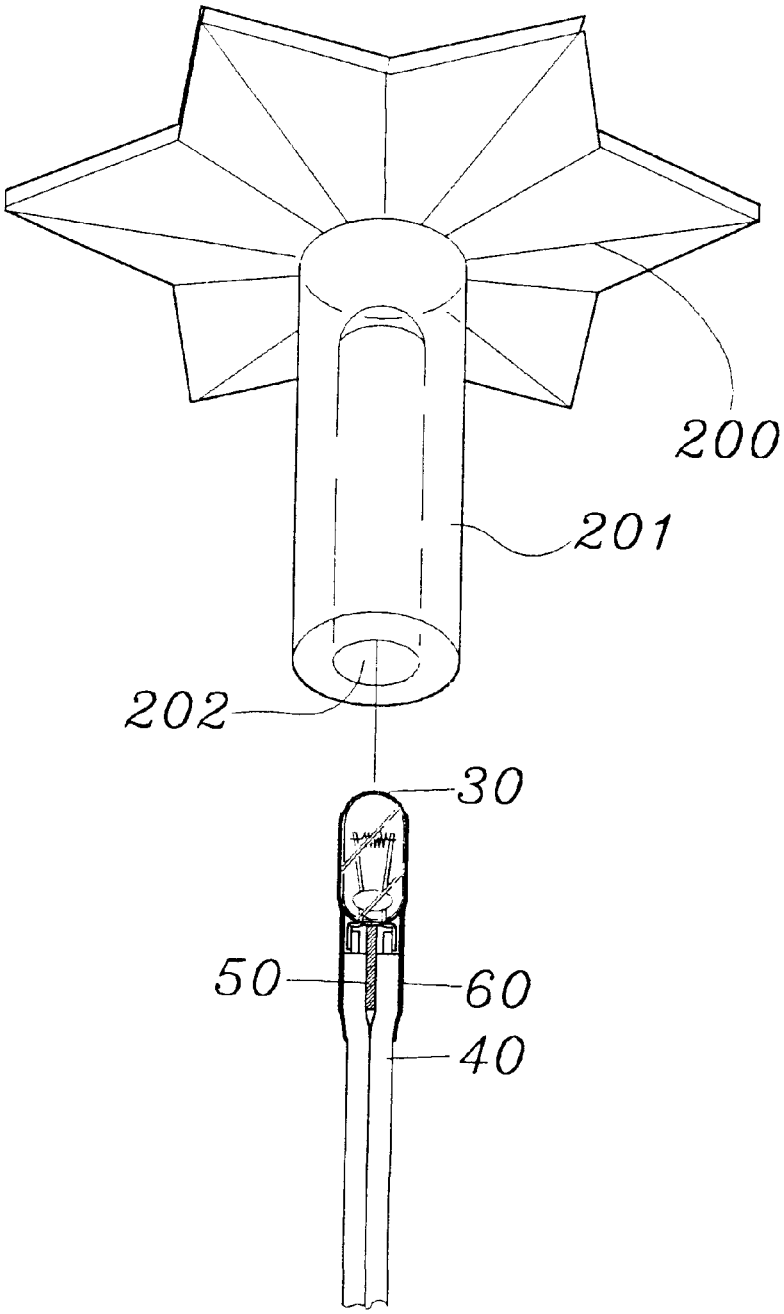
FIG. 7 is an exploded perspective view showing the assembling of the present invention with another decorative structure.

In another embodiment of the present invention shown in FIG. 7, the decoration member 20 is in the shape of a flower, with a sleeve 201 extending from the central bottom thereof. The sleeve 201 has a through hole 202 of suitable depth to accommodate therein the crab-eye style lamp. The decoration member 200 and the sleeve 201 are made of light penetrable material, and the miniature lamp bulb is located beneath the center of the flower, so that the flower can show attractive brilliance when the lamp is illuminated and shining.

From the above stated embodiments, it can be seen that, decoration members can have various configurations as long as the decoration member has an extension portion formed integrally therewith and a positioning hole is provided in the extension portion for receiving therein a crab-eye style lamp.

The improved design of crab-eye style lamp of the present invention enables the miniature lamp bulb and its conductors to be further received in and combined with a decoration member to obtain more ideal and perfect sealing with a leakage-proof function. It can meet severe standards of safety, and can get an attractive decorative effect by the fact that the miniature lamp bulb is received with the conductors in a more suitable position in the decoration member.

The embodiment cited above is only for illustrating a preferred embodiment of the present invention. It will be apparent to those skilled in this art that various modifications or changes can be made to the elements of the present invention without departing from the spirit and scope of this invention. Accordingly, all such modifications and changes, such as different fashions for the decoration member, also fall within the scope of the appended claims and are intended to form part of this invention.

What is claimed is:

1. A protecting and decorative structure comprising: a crab-eye style lamp having a lamp bulb with a bottom surface with two exposed conductor sections extending therefrom connected with a pair of conductors having conductor sections which are separated and positioned by an insulation block; a thin sleeve heat shrunk on a connecting area between said conductor sections and said insulation block; and a decoration member made of light penetrable material having a positioning hole in communication with an outside, said positioning hole extending into said decoration member for a predetermined depth, whereby said connecting area between said lamp bulb and said insulation block completely enters said positioning hole of said decoration member; said insulation block including on two lateral sides thereof two axially directed grooves positioning said conductor sections, and a knurled external wall.

2. The protecting and decorative structure for a crab-eye style lamp as claimed in claim 1, wherein, said lamp is hermetically fixed in said positioning hole with glue.

3. The protecting and decorative structure for a crab-eye style lamp as claimed in claim 1, wherein, said lamp is mounted in said positioning hole by heat shrinking.

4. The protecting and decorative structure for a crab-eye style lamp as claimed in claim 1, wherein, said decoration member has an extension formed integrally therewith and said positioning hole is located in the extension.

5. A protecting and decorative structure comprising: a crab-eye style lamp without a lamp holder, having a lamp bulb with a bottom surface with two exposed conductor sections extending therefrom connected with a pair of conductor sections which are separated and positioned by an insulation block; a thin sleeve heat shrunk on a connecting area between said lamp bulb and said insulation block; a decoration member made of light penetrable material having a positioning hole in communication with an outside, said positioning hole extending into said decoration member for a predetermined depth, whereby said connecting area between said lamp bulb and said insulation block completely enter said positioning hole of said decoration member; said insulation block is provided with two axially directed through holes separating and positioning said conductor sections and provided with a knurled external wall.

6. The protecting and decorative structure for a crab-eye style lamp as claimed in claim 5, wherein, said lamp is hermetically fixed in said positioning hole with glue.

7. The protecting and decorative structure for a crab-eye style lamp as claimed in claim 5, wherein, said lamp is mounted in said positioning hole by heat shrinking.

8. The protecting and decorative structure for a crab-eye style lamp as claimed in claim 5, wherein, said decoration member has an extension formed integrally therewith and said positioning hole is located in the extension.

* * * * *